United States Patent [19]

Dewert

[11] Patent Number: 5,075,911

[45] Date of Patent: Dec. 31, 1991

[54] ADJUSTING DEVICE FOR A LATTICE PLATE EQUIPPED WITH AT LEAST A TILTABLE BACK PART AND A TILTABLE FOOT PART

[76] Inventor: Eckhart Dewert, Dorfstrasse 155, 4904 Enger, Fed. Rep. of Germany

[21] Appl. No.: 455,416

[22] PCT Filed: May 6, 1989

[86] PCT No.: PCT/DE89/00290

§ 371 Date: Dec. 12, 1989

§ 102(e) Date: Dec. 12, 1989

[87] PCT Pub. No.: WO89/10715

PCT Pub. Date: Nov. 16, 1989

[30] Foreign Application Priority Data

May 7, 1988 [DE] Fed. Rep. of Germany ... 8806094[U]

[51] Int. Cl.[5] ..... A61G 7/05

[52] U.S. Cl. ..... 5/68

[58] Field of Search ..... 5/66, 67, 68, 74, 69

[56] References Cited

U.S. PATENT DOCUMENTS

| | | | |
|---|---|---|---|
| 3,129,607 | 4/1964 | Schaefer | 5/68 X |
| 3,921,230 | 11/1975 | Hanning et al. | 5/68 |
| 4,120,057 | 10/1978 | Neumann | 5/68 X |
| 4,271,545 | 6/1981 | Christian, III | 5/68 X |
| 4,381,571 | 5/1983 | Elliott | 5/68 X |
| 4,685,159 | 8/1987 | Oetiker | 5/68 X |

FOREIGN PATENT DOCUMENTS

| | | | |
|---|---|---|---|
| 683070 | 11/1952 | United Kingdom | 5/68 |

*Primary Examiner*—Gary I. Smith
*Assistant Examiner*—Michael J. Milano
*Attorney, Agent, or Firm*—Michael J. Striker

[57] ABSTRACT

An adjusting device is to be constructed in such a way that it is possible to dispense with cable placement or wiring work. Moreover, fastening elements included as loose parts are dispensed with, so that the adjusting device is simpler for the user to handle. The adjusting drives needed for the adjustment of the foot part and the head part are arranged in a box-like housing (10). The adjusting spindles are assigned to the oppositely located front ends of the housing (10). Guides for the adjusting nuts (14) are formed on at the inner surfaces of the housing (10). Moreover, the housing (10) is provided with catch means for fixing the adjusting drives (11). The control of the two adjusting drives is effected jointly or independently from one another by means of one control unit (24).

The adjusting device, according to the invention, is to be used particularly for beds in the living area.

11 Claims, 7 Drawing Sheets

ADJUSTING DEVICE FOR A LATTICE PLATE EQUIPPED WITH AT LEAST A TILTABLE BACK PART AND A TILTABLE FOOT PART

BACKGROUND OF THE INVENTION

The present innovation is directed to an adjusting device for a lattice plate of a bed equipped with at least a swivelable back part and a swivelable foot part. The back part and the foot part are adjustable by an electric-motor adjusting drives each having an adjusting spindle and an adjusting nut screwed on to the spindle.

A lattice plate, known in general, usually comprises a foot part, a back part and possibly also a head part which are swivelable, respectively, around a horizontal axle for the purpose of adjusting to the desired reclining position. The previously known adjusting devices comprise a plurality of electric-motor adjusting drives whose piece numbers agree with the number of parts to be adjusted. Thus, an individual drive is assigned to the back part, to the foot part and possibly also to the head part, respectively.

This construction, known per se, has the disadvantage that every individual adjusting drive must be mounted separately, so that fastening parts are necessary for every adjusting drive. The previously known adjusting device is therefore not only costly with respect to construction, but also requires a considerable assembly cost on the part of the producer of the lattice plate and bed. Moreover, handling is quite uncomfortable for the user, since the individual adjusting drives can only be actuated independently of one another. For example three switches must be actuated in order to bring the back part, foot part and head part from an angular position into a horizontal position corresponding to the sleeping position. Moreover, another disadvantage in the previously known construction is that the frame and the fastening parts are extremely heavily loaded, since the flow of force is effected via the frame and the fastening parts.

SUMMARY OF THE INVENTION

The present invention has the object of developing an adjusting device which is constructed in a simple manner so as to be compact, is simple to mount both for the producer of the adjusting device and for the producer of the lattice plate without additional cable installation and wiring work and without the need for additional fastening parts included as loose parts, and is also simple to handle for the user.

In order to meet this object, it is provided, according to the innovation, that at least the adjusting drives are arranged in a box-like housing, the adjusting spindles are located opposite to one another, guides are provided in the housing for the adjusting nuts which are screwed on the adjusting spindles, catch means for fastening the adjusting drives are provided at least at the inner surfaces of the side walls of the housing, and the adjusting drives are actuable simultaneously or independently from one another by means of a joint control unit.

The adjusting drives are known linear drives. Since they are now arranged in a box-like housing, a constructional unit is formed which is easy for the producer of the lattice plate to install. Since the adjusting nuts screwed on the adjusting spindles are supported in guides in the operating state, the parts which would otherwise be necessary for preventing a rotation of the nut are dispensed with. Moreover, the fastening parts or fittings are loaded only to an extremely slight degree, since the flow of force is effected exclusively through the housing. This results in a considerable stabilization of the frame of the lattice plate. Since all adjusting drives can be actuated simultaneously as well as independently of one another by means of a joint control unit, a lattice plate can be brought into a sleeping position, e.g. from a reading position, in an extremely comfortable manner. In order to increase the stiffening and twisting strength, it is advisable that the housing comprise longitudinal and/or transverse stiffening ribs. Since the housing is loaded most intensively in the area of the receptacles for fittings, the housing is advantageously constructed so as to have a double wall in this area and/or is provided with reinforcements. However, the greatest strength of the adjusting device, in its entirety, is achieved when the housing is closed at the top by means of a screwed on cover. The housing can be produced in an inexpensive manner with the necessary strength if it is manufactured from a heavy-duty, impact-resistant, flexible nondeformable plastic.

In order to further simplify the assembly for the producer of the lattice plate, it is provided in a further development of the invention that recesses, whose base is constructed as a semicircle and which are flush with one another in the area of the front ends, are provided in the side walls of the housing, that the horizontal axles carrying the back part and foot part are inserted in the recesses, and that the areas of the side walls having the recesses comprise horizontal guide grooves on the inside. Also a slide which overlaps the recesses and the horizontal axles and is locked in the inserted position is insertable in the horizontal guide grooves. The height of the recesses corresponds to the diameter of the horizontal axles, so that the axles are fixed in the recesses in a positive-locking manner. The slide prevents the housing from falling down in the mounted state. In order to install the adjusting device, the producer of the lattice plate need only displace the slide far enough so that the recesses are open. After the housing is attached, the slide need only be slid back into the locked operating position. Therefore, neither fittings nor other fastening parts or tools are required for the attachment.

It is advisable that the control unit be arranged in the interior of the housing as a compact unit so that the producer of the lattice plate does not need any additional installation work in addition to the attachment of the housing. The adjusting drives can be operated with normal power supply voltage, with a reduced power supply voltage or by means of a chargeable storage cell. Depending on the construction, it may be necessary to equip the control unit with a transformer reducing the power supply voltage or with a storage cell which is chargeable by means of a charging device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
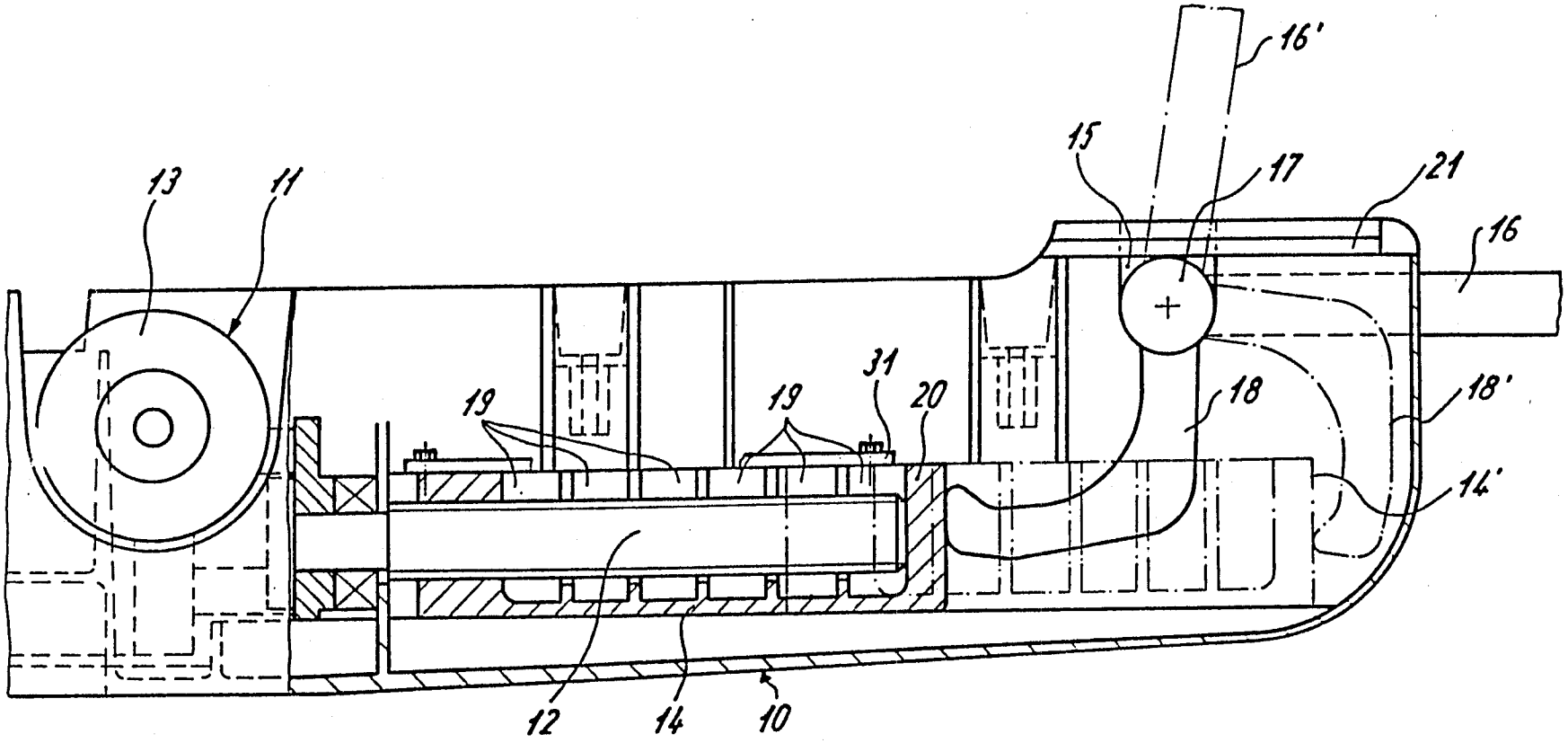
FIG. 1 shows the adjusting device, according to the innovation, in partial vertical section.
Figure 2:
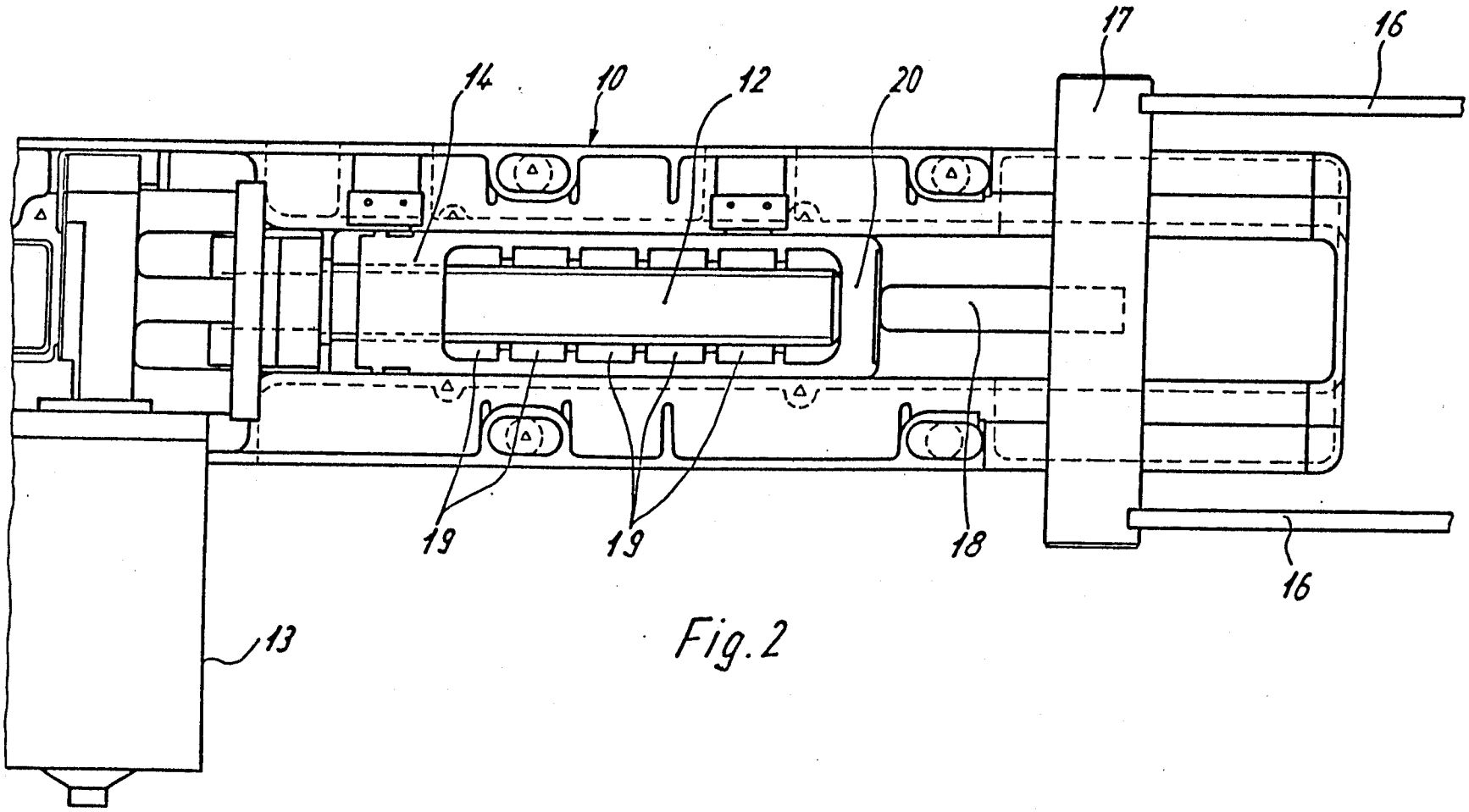
FIG. 2 shows a top view corresponding to FIG. 1.

FIGS. 1 and 2 show only a portion of a housing 10 in which two adjusting drives 11 are arranged which are constructed as linear drives. FIGS. 1 and 2 show only one adjusting drive. The second adjusting drive is arranged in a mirror-inverted manner. Every adjusting drive 11 comprises an adjusting spindle 12 which is driven via a gear unit, not explained in more detail, by a drive motor 13. An adjusting nut 14 is screwed on every adjusting spindle 12. The housing is constructed in a box-like manner and is closed by means of a cover 30 which is shown more exactly in FIGS. 5 and 6. The free front edges of the cover 30 lie at a distance to the left in FIG. 1 from the front edges of the housing 10 (which are the right edges in FIG. 1). The areas of the side walls of the housing 10 lying between the front edges of the cover 30 and the front edges of the housing 10 project upward relative to the cover. In this area, the side walls of the housing 10 are provided with two aligned recesses 15 with a semicircular base. A horizontal axle 17 projects at both sides outwardly beyond the side walls of the housing 10 and forms the swivel axis. The axle 17 forms an axis for a back part or a foot part 16 and lies in the recesses 15. The parallel cross-pieces of the back part or foot part 16 sit on the projecting ends of the axle 17. Moreover, an angle lever 18 located in the center plane of the housing 10 is placed on the horizontal axle 17 so as to be fixed against rotation relative to it. The free leg of the angle lever 18 is parallel or approximately parallel to the back part or foot part 16, but extends in the opposite direction. As shown in FIGS. 1 and 2, the adjusting nut 14 is constructed as a sliding nut with a length which corresponds approximately to the length of the threaded part of the adjusting spindle 12. The thread piece of the adjusting nut 14 is relatively short with respect to the length of the adjusting nut 14. The threadless partial piece of the adjusting nut 14 is constructed so as to be U-shaped in cross section. Its open side lies so as to face the top of the housing 10 and the cover 30, respectively, and is closed with a guide plate 31. The threadless partial piece of the adjusting nut 14 is provided with internal ribs for reinforcement. The end lying opposite the threaded part of the adjusting nut 14 is closed by means of a front wall 20. The outer surface of the front wall 20 and the free end of the angle lever 18 contact one another. FIG. 1 shows the horizontal position of the back or foot part 16 in solid lines. In this position, the adjusting nut 14 is in the left end position, i.e. facing the drive motor 13. The angle lever 18 remains constantly in contact with the adjusting nut 14 by means of the inherent weight of the foot or back part 16. The other end position of the adjusting nut 14 is designated by 14' and is shown in dash-dot lines. The swiveled out position of the foot part or back part 16 and of the angle lever 18 is also shown in the same manner and is designated by reference numbers 16' and 18', respectively. The adjustment of the foot or back part 16 is effected in a continuous manner. The guide plate 31 is screwed together with the housing 10 above the adjusting nut 14 in order to improve the guidance of the adjusting nut 14. The side walls of the housing 10 are provided on their inner sides with guide grooves extending between the front ends of the cover 30 and the front ends of the housing 10. The guide grooves lie at the same neight, and a slide 21 being inserted into the guide grooves. The horizontal axle 17 is accordingly fixed in the housing 10.

The horizontal axle 17 is part of the lattice plate, not shown. In order to install the adjusting device, the slide 21 must be moved out far enough so that the recesses 15 are released. After the angle lever 18 has been arranged on the horizontal axle 17 in the correct position and fixed on it, the complete housing 10 can be attached to the lattice plate in such a way that the horizontal axle 17 lies in the recesses 15. The slide can then be moved back into the original position again, so that the housing is fixed in the correct position. No tools or other fittings are necessary for this.

Figure 3:
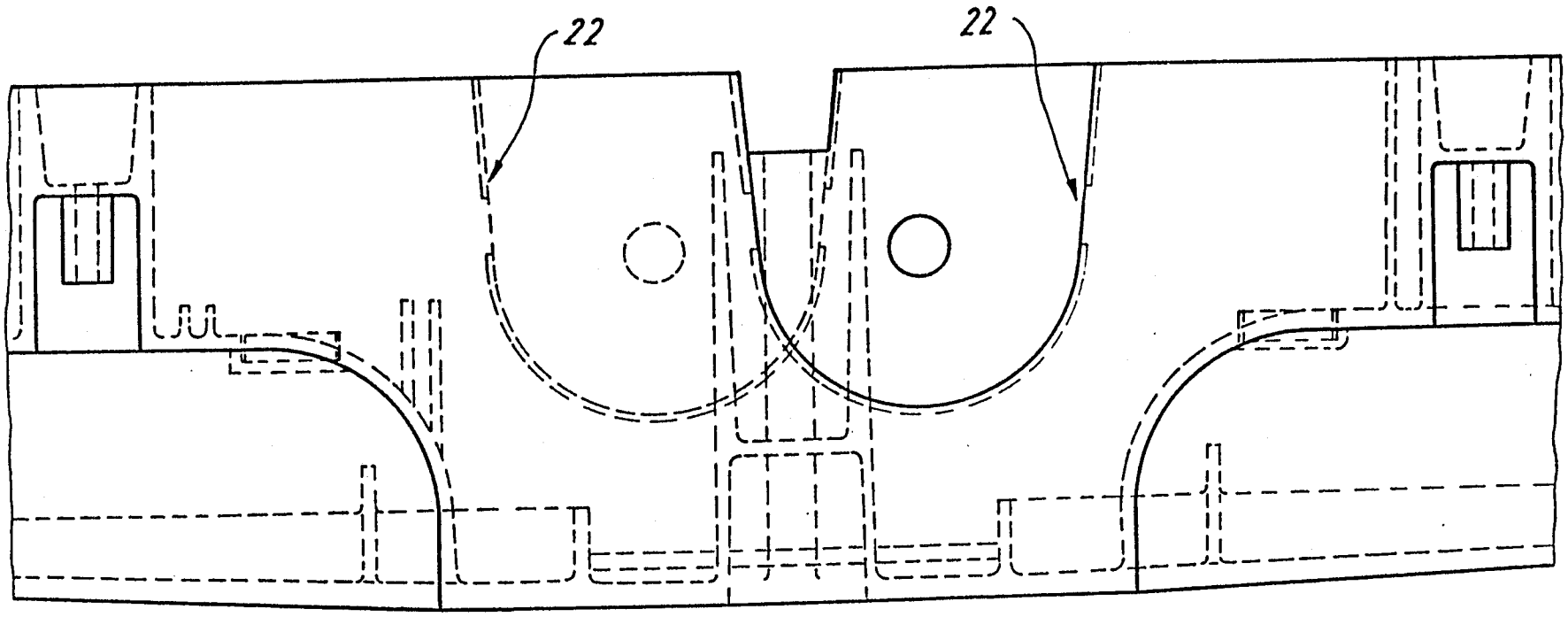
FIG. 3 shows the housing, according to FIG. 1, in partial view showing the middle area.

The middle portion of the housing is shown in FIG. 3. As can be seen from this figure, the side walls of the housing 10 are provided with a recess 22 in order to receive the outwardly projecting drive motor 13. It can be seen from the drawing that the recesses 22 are offset relative to one another. The plane lying in the middle between the two axes of symmetry of the recesses 22 forms the mirror plane for the adjusting drives 11 constructed in the same manner. Every completely preassembled adjusting drive 11 is inserted into the housing 10 as a constructional unit without tools being necessary for this. The fastening is effected by means of webs of the cover 30, as will be explained. The producer of a lattice plate or a bed also obtains from the producer of the adjusting device a complete constructional unit which is extremely simple to install in the manner already explained.

Figure 4:
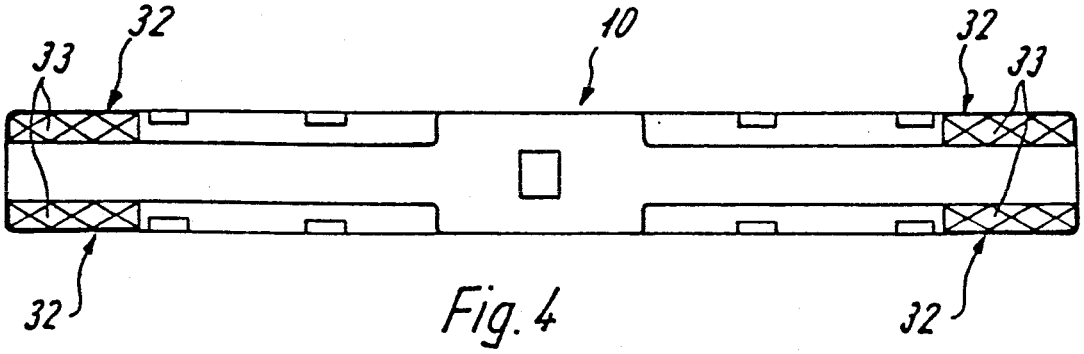
FIG. 4 shows a view of the housing from below.

It can be seen from FIG. 4 that the housing 10 has a double wall in the area of the recesses 15 for the horizontal axles 17 in order to increase the loading capacity. The double wall is designated by the reference number 32. Moreover, reinforcements 33 are provided in this area.

Figure 5:
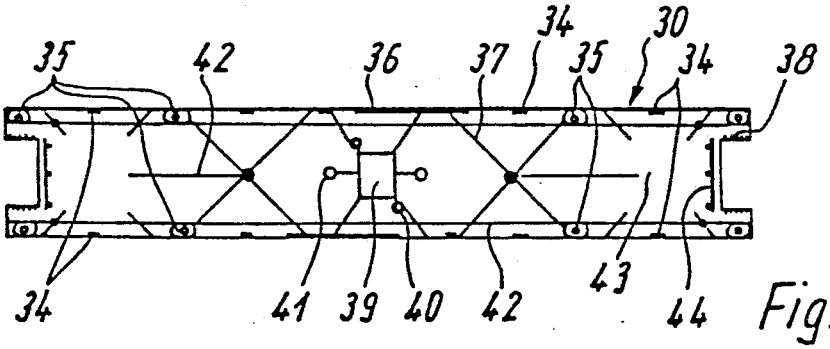
FIG. 5 shows a cover closing the housing, seen from the interior of the housing.
Figure 6:
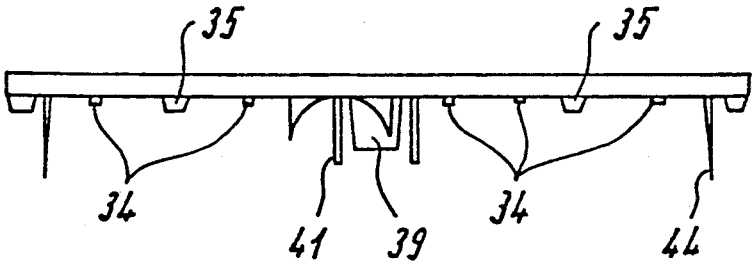
FIG. 6 shows a side view corresponding to FIG. 5.
Figure 10:
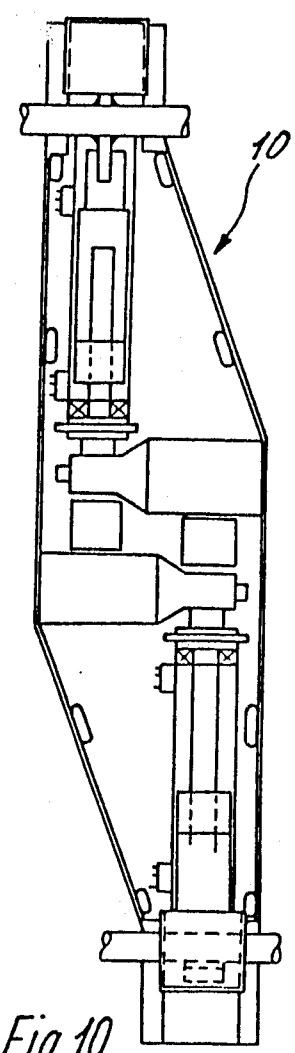
FIGS. 7 to 10 shows different cross-sectional shapes of the housing.
Figure 9:
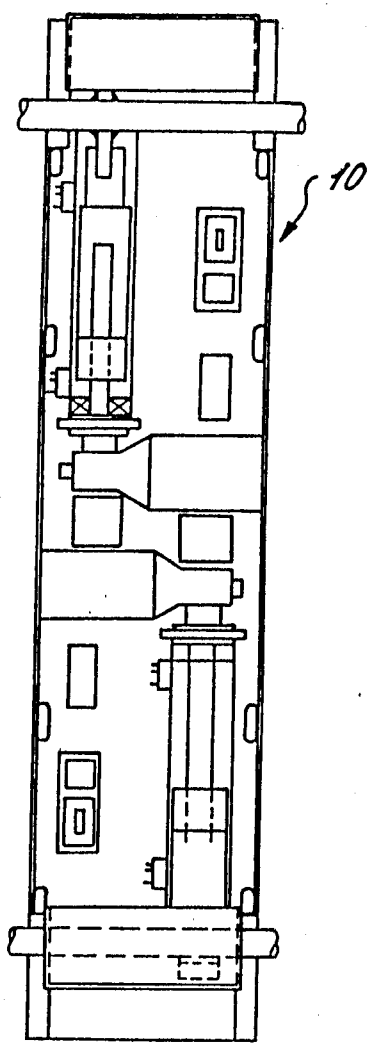
Figure 8:
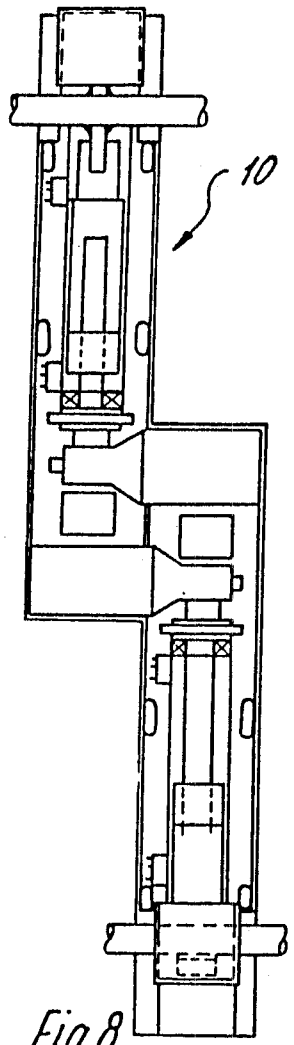
Figure 7:
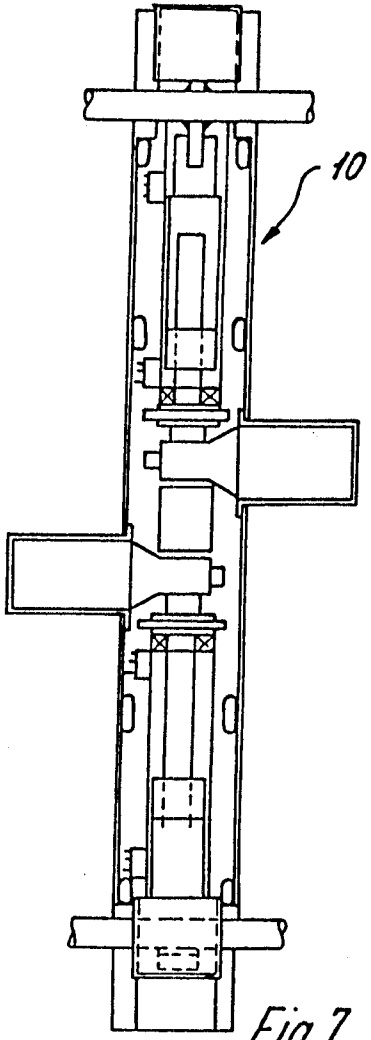

FIG. 5 shows the cover as seen from the side of the housing. The cover has a plurality of mortise brackets 34. The pegs comprising a bore hole for the fastening screws are designed by 35. Moreover, the cover has cover connections 36, transverse ribs 37, protuberances 38 for locking the slide 21, center pegs 39 as a motor support, center screw holes 40, motor support webs 41, longitudinal ribs 42, free spaces 43 for transformers, and aprons 44 for the mechanical protection of the electrical parts. A particularly high stability is achieved by means of the cover 30. Moreover, the electrical parts are protected by means of the diverse parts. No special fastening parts are necessary for the motors of the adjusting drives. The slides 21 are provided, in a manner not shown, with a profile which engages in the protuberances 38 so as to catch.

FIGS. 7 to 10 show various constructions of the housing 10. In the construction according to FIG. 7, the motors of the adjusting drives 10 lie outside of the housing. However, the adjusting spindles 12 lie so as to be flush relative to one another. This construction results in a particularly narrow housing. In the construction according to FIG. 8, the motors of the adjusting drives 11 are arranged inside the housing. Since the adjusting spindles are offset relative to one another, the parts of the housing assigned to an adjusting drive are also offset relative to one another, and their two side walls are flush with one another. In the construction according to FIG. 9, the adjusting spindles 12 are likewise offset relative to one another. Since the motors of the adjusting drives 11 are also arranged within the housing 10, the housing is rectangular and has a greater width. In the construction according to FIG. 10, the motors of the adjusting drives 11 again lie within the housing and the adjusting spindles 12 are offset relative to one another. However the housing 10 is constructed so as to be asymmetrical in such a way that the lateral housing walls are inclined relative to the adjusting spindles 12 in the area of the adjusting spindles 12.

Figure 11:
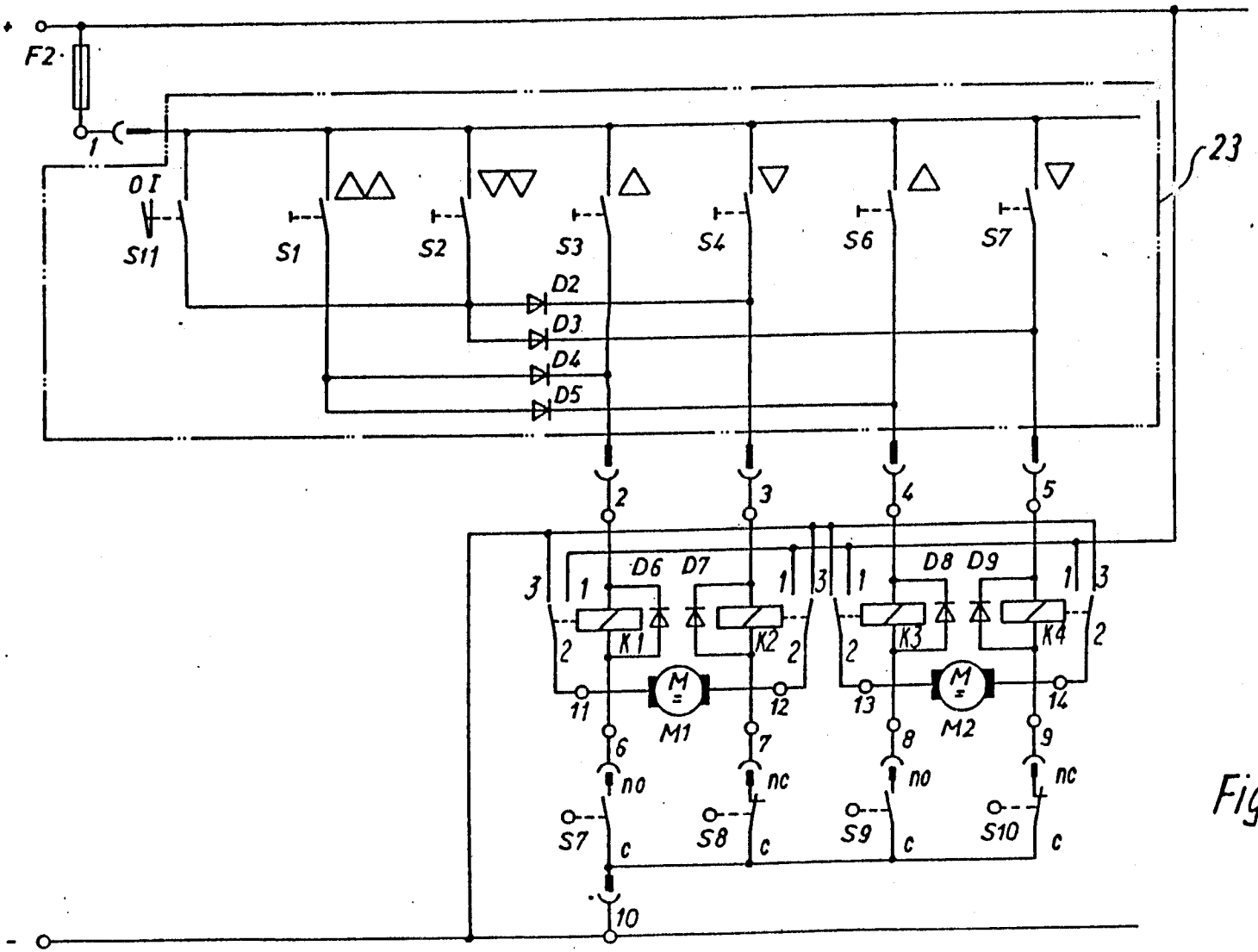
FIG. 11 shows a wiring diagram of the innovation for a device according to FIGS. 1 to 10.

In the wiring diagram according to FIG. 11, a hand-switch housing 23 is indicated in dash-dot lines and is electrically connected, via a five-pole plug connection, with the control unit, generally designated by 24, which is arranged in the housing 10. The hand-switch housing 23 is equipped with electric control elements for controlling the drive motors 13 which are designated by M1 and M2 in FIG. 11. Six operator keys S1, S2, S3, S4, S6, S7 are mounted in the hand-switch housing 23. The motor M1 can be controlled by means of operator keys S3 and S4, the motor M2 can be controlled by means of operator keys S6, S7. Two operator keys are necessary for every motor, since an operator key is needed for each rotating direction. The motor M1 could be used e.g. for adjusting the head part and the motor M2 could be used for adjusting the foot part. Both motors M1, M2 can be controlled simultaneously by means of operator keys S1 and S2. Moreover, an additional operator key, constructed in the present embodiment example as a sliding switch S11, is arranged in the hand-switch housing 23 in order to switch on both motors M1, M2 with a rotating direction such that the foot part and the back part are lowered, i.e. swiveled back into a sleeping position. Moreover, four diodes D2 to D5 are arranged in the hand-switch housing in order to decouple the operator keys S1, S2, S3, S4, S6 and S7 from one another. The control unit 24 formed as a control plate, is equipped with a fuse F2. Moreover, it has four relays K1 to K4 and four free-running diodes D6 to D9 which are necessary in case a remote control with transistor output is used instead of the hand-switch housing. The connections of the hand-switch housing 23 are designated by numbers 1 to 5. In the present embodiment example, the end positions of the adjusting nuts 14 are controlled by means of end switches, not shown. In FIG. 11, the connections of the end switches S7 to S10 are designated by numbers 6 to 9 and 10'. The motor connections are designated by numbers 11' to 14'. The current supply is indicated by the symbols + and −.

The functioning of the motor M1 is described in the following. The functioning of the motor M2 is the same, so that it need not be described. The drawing shows the drive motors 13 and M1, M2, respectively, with moved out adjusting nuts 14. The relays K1, K2, the operator keys S3, S4 and the end switches S7, S8 are assigned to the motor M1. When the operator key S3 is pressed, the relay K1 does not open, since the upper end switch S7 is open. If the operator key S4 is pressed, the relay K2 opens, since the lower end switch S8 is still closed. The switching contact of the relay K2 switches over, so that the motor M1 receives voltage, i.e. is set in rotation for moving in the adjusting nut 14. The motor M1 turns off as soon as the operator key S4 is released, since the relay K2 is released and the assigned contacts are opened. Two additional contacts close in order to brake the motor M1 with respect to the generator, as will be described in more detail. If the operator key S4 is pressed until the adjusting nut 14 actuates the end switch S8, the previously described process likewise takes place.

In order to keep the foot or back part 16 in each position, the control unit is designed in such a way that the motor is electrically loaded to a great degree when it is stationary or turned off, so that an immediate braking or an immediate stopping is achieved. Moreover, the motor shaft can be rotated when stationary only by means of a great expenditure of force. In addition, the motor M1 is short-circuited by means of the relays K1, K2 with the assigned switching contacts.

When the adjusting nut 14 is located in a center position, the motor M1 can be set in rotation by means of pressing either operator key S7 or S8, since the end switches S7 or S8 are closed when pressing the operator key S3 or S4, respectively. The respective swiveling movement of the foot or back part 16 is designated by the triangle. If both operator keys S3, S4 are pressed inadvertently, the motor M1 stops, since the relays K1 and K2 are opened, so that the generator is braked. As soon as one of the operator keys S3 or S4 is released, the motor M1 starts again.

Figure 12:
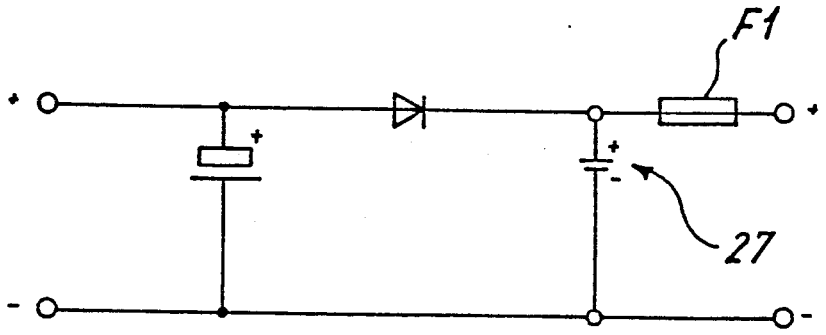
FIG. 12 shows the current supply of the adjusting device with the use of a transformer.
Figure 13:
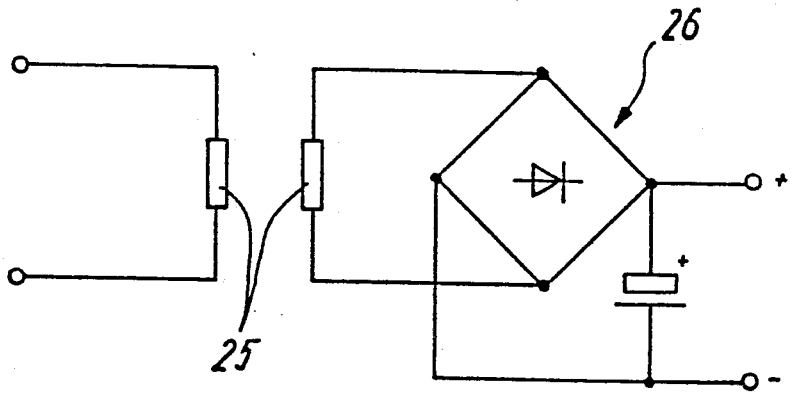
FIG. 13 shows the current supply of the adjusting device by means of a storage cell, as block wiring diagram.

FIG. 12 shows the current supply by means of a transformer. The input voltage is accordingly reduced from e.g. 220 V to approximately 26 V. The symbolically shown transformer is designated by 25. A bridge rectifier equipped with a capacitor is designated generally by reference number 26.

FIG. 12 shows the current supply by means of a storage cell 27. The storage cell 27 is charged by means of a charging device. A fuse is designated by F1.

It is also conceivable to equip the adjusting device with a so-called memory circuit in a manner not shown in detail. Accordingly, it is possible to store the position of the adjusting nut 14 corresponding to a determined angular position of the foot or back part 16 and to retrieve it again as needed. For this purpose, a storage arrangement is provided in the hand-switch housing 23. A plurality of switches, e.g. end switches, are installed below the adjusting nuts 14'. The switches determine the respective position of the adjusting nut 14 and transmit it to an electronics plate arranged in the housing 10. A plurality of switch channels can then be provided below the adjusting nut 14.

I claim:

1. An adjusting device for a lattice plate of a bed equipped with at least a swivelable back part and a swivelable foot part, comprising adjusting drives for displacing said back part and said foot part and each including an electric motor, an adjusting spindle and an adjusting nut screwed on said adjusting spindle; a housing closeable by a cover and having front and side walls, said adjusting drives being accommodated in said housing so that said adjusting spindles being arranged opposite to one another to face said front walls; a control unit located in said housing and operative for jointly or independently actuating said adjusting drives; guides provided in said housing for said adjusting nuts screwed on said adjusting spindles; catch means provided at least on inner surfaces of said side walls of said housing for fixing said adjusting drives; a plurality of motor holding webs and a central motor supporting pin provided on said cover and projecting into said housing; recesses provided on said side walls of said housing so as to be flush with one another in the area of their front ends and having semi-circular bases; horizontal axles arranged to carry the back part and the foot part and inserted in said recesses; horizontal guide grooves provided in regions of said side walls which have said recesses; and a slide insertable in said guiding grooves and overlapping said recesses and said horizontal axles and locked in an inserted position.

2. An adjusting device as defined in claim 1, wherein said slide has shaped webs, said cover having a plurality of protuberances which form a toothing engageable in said shaped web of said slide.

3. An adjusting device as defined in claim 2, wherein said cover has front ends, said protuberances being provided in the region of said front ends.

4. An adjusting device as defined in claim 1, wherein said cover has aprons extending into said housing and serving for mechanical protection of electrical parts.

5. An adjusting device as defined in claim 4, wherein said cover has front ends, each of said aprons being provided on a respective one of said front ends of said cover.

6. An adjusting device as defined in claim 1, wherein said horizontal axles have a predetermined diameter, said recesses having a height corresponding to said diameter of said horizontal axles.

7. An adjusting device as defined in claim 6, wherein said side walls of said housing have an upper edge and a bottom, said recesses extending from said upper edge to said bottom of said side walls of said housing.

8. An adjusting device as defined in claim 1, wherein each of said adjusting nuts is formed as a sliding nut having an inner thread extending over a relatively short portion of a total length of said adjusting nut.

9. An adjusting device as defined in claim 8, wherein each of said adjusting nuts has a thread-free part having a U-shaped cross-section and provided with an open side which faces said cover and with a plurality of internal ribs for reinforcement of said adjusting nut.

10. An adjusting device as defined in claim 1; and further comprising a guiding plate arranged above each of said adjusting nuts and connected with said housing.

11. An adjusting device as defined in claim 1; and further comprising an angled lever located in said housing and having a free leg extending at least substantially parallel to the back part and the foot part, said angled lever contacting a free front surface of said adjusting nut and connected with a respective one of said horizontal axles for joint rotation therewith.

* * * * *